US012781329B2

(12) United States Patent
Huang et al.

(10) Patent No.: US 12,781,329 B2
(45) Date of Patent: Nov. 3, 2026

(54) SUPER ELECTROCHEMICAL CORROSION-RESISTANT BILAYER PASSIVE FILM STRUCTURE AND STAINLESS STEEL SUITABLE FOR WATER ELECTROLYSIS INDUSTRY

(71) Applicant: THE UNIVERSITY OF HONG KONG, Hong Kong (CN)

(72) Inventors: Mingxin Huang, Hong Kong (CN); Kaiping Yu, Shenzhen (CN)

(73) Assignee: THE UNIVERSITY OF HONG KONG, Hong Kong (CN)

( * ) Notice: Subject to any disclaimer, the term of this patent is extended or adjusted under 35 U.S.C. 154(b) by 745 days.

(21) Appl. No.: 18/137,666

(22) Filed: Apr. 21, 2023

(65) Prior Publication Data

US 2023/0340678 A1 Oct. 26, 2023

(30) Foreign Application Priority Data

Apr. 21, 2022 (CN) ..... 202210425259.5

(51) Int. Cl.

| | |
|---|---|
| ***C22C 38/58*** | (2006.01) |
| ***C22C 38/02*** | (2006.01) |
| ***C22C 38/04*** | (2006.01) |
| ***C25B 1/04*** | (2021.01) |
| ***C25B 11/053*** | (2021.01) |

(52) U.S. Cl.
CPC ..... *C22C 38/58* (2013.01); *C22C 38/02* (2013.01); *C22C 38/04* (2013.01); *C25B 1/04* (2013.01); *C25B 11/053* (2021.01)

(58) Field of Classification Search
CPC ..... C22C 38/58; C25B 1/04; C25B 11/053
See application file for complete search history.

(56) References Cited

U.S. PATENT DOCUMENTS 5,501,834 A * 3/1996 Nakasuji ..... C22C 38/38 420/583
2019/0226066 A1* 7/2019 Sawamura ..... C22C 38/58

FOREIGN PATENT DOCUMENTS

CN 113817969 A 12/2021

OTHER PUBLICATIONS

Yu et al., A sequential dual-passivation strategy for designing stainless steel used above water oxidation, 70 Materials Today (Year: 2023).*
Filonov et al., Original & Machine Translation, RU 2625514 C1 (Year: 2017).*

* cited by examiner

*Primary Examiner* — Hosung Chung
(74) *Attorney, Agent, or Firm* — Leason Ellis LLP

(57) ABSTRACT

A bilayer passive film structure of a substrate, comprising an inner layer comprising an oxide of a first element, and an outer layer comprising an oxide of a second element, wherein the passivation potential of the first element is lower than the passivation potential of the second element, and the passivation potential of the second element is lower than the transpassivation potential of the first element. Also a method of forming the above bilayer passive film structure of a substrate, comprising: treating a surface of the substrate containing Cr and Mn. Further a stainless steel comprises, in percentage by weight, 15%<Cr<22%, 13%<Mn<23%, 12%<Ni<23%, and 0.5%<Si<4%, wherein Si can be replaced with an equal amount of Al, Ti or V.

20 Claims, 6 Drawing Sheets

SUPER ELECTROCHEMICAL CORROSION-RESISTANT BILAYER PASSIVE FILM STRUCTURE AND STAINLESS STEEL SUITABLE FOR WATER ELECTROLYSIS INDUSTRY

CROSS REFERENCE TO RELATED APPLICATION

Priority is claimed to Chinese Application No. 2022-10425259.9 filed Apr. 21, 2022, the contents of which are incorporated herein by reference in their entirety.

FIELD OF THE INVENTION

The present invention relates to the field of materials, especially, to a super electrochemical corrosion-resistant bilayer passive film structure and stainless steel suitable for water electrolysis industry.

BACKGROUND

Stainless steel is a class of alloy steel with corrosion and rust resistance under the protection of a surface passivation state, which has generally a relatively high chromium (Cr) content (typically, 12% to 30%), and other elements such as nickel (Ni), molybdenum (Mo), vanadium (V), tungsten (W), etc. Chromium plays the most important role in the formation mechanism of the passivation state of stainless steel. The passivation of stainless steel mainly comes from an oxide film with a dense structure formed by the oxidation of chromium (Cr). Adding an amount of nickel (typically, >8%) into stainless steel can form a single austenitic structure. Such composition design can result in stainless steel with a simple structure and uniform composition by thermal treatment and has a great meaning in the development of steel species with better corrosion resistance.

In general, stainless steel often undergoes pitting, especially in a chlorine (Cl) ion-containing environment. Pitting corrosion is a type of local corrosion, which refers to the corrosion that occurs due to the rupture of the passive film of stainless steel in a very small area. The pitting often has a small pore size (<1 mm), and extends towards the inside of the stainless steel, while most of the area around the pit surface is not corroded or only slightly corroded. Generally, the pitting resistance of the stainless steel can be measured by "pitting potential," which refers to the minimum potential capable of causing pitting on the surface of the stainless steel during electrochemical corrosion. To increase the pitting resistance of the stainless steel, a small amounts of other elements such as molybdenum (Mo), nitrogen (N), copper (Cu), and tungsten (W) are added into the stainless steel to produce a synergistic oxidation effect by which a passive film can be formed to greatly improve the pitting resistance of the stainless steel. For example, 2-3 wt % of molybdenum (Mo) element is added based on 304 stainless steel to give a 316 stainless steel, of which the chlorine (Cl) ion corrosion resistance is substantially improved.

This synergistic oxidation effect can be quantified via a large number of experiments to finally obtain an empirical formula, i.e., the Pitting Resistance Equivalent Number (PREN). The PREN correlates the chemical composition of the stainless steel directly with the pitting resistance, and the value thereof can be used to evaluate the pitting resistance. The commonly used formula of PREN is PREN=Cr (wt. %)+3.3*Mo (wt. %)+16*N (wt. %), and the most successful steel species using this design scheme is the super stainless steel, such as the 254 SMO austenitic super stainless steel. The 254 SMO comprises 6.0-6.5 wt % of molybdenum (Mo), and 0.18-0.2 wt % of nitrogen (N). Due to the high molybdenum (Mo) level in the 254 SMO, it has a very strong pitting resistance and can be used in seawater for a long time. Moreover, the 254 SMO would not undergo pitting in a 3.5 wt % solution of sodium chloride (NaCl), using a standard test of the potentiodynamic polarization of the surface. However, when the potential reaches greater than 1000 mV (saturated calomel reference electrode), the 254 SMO and other super stainless steels will also undergo transpassivation corrosion. Transpassivation corrosion is total corrosion, which is caused by the trivalent chromium in the passive film being further oxidized to generate water-soluble hexavalent chromium so that the oxidation film dissolves and the metal substrate is exposed to the environment. It can be seen that all the materials protected by a chromium element passive film will undergo a transpassivation corrosion when the trivalent chromium oxide dissolves, while the materials designed based on such an oxidation mechanism cannot be used in a high potential environment. For example, the potential at which water is electrolyzed generally is slightly higher than the transpassivation potential of chromium.

As a world-recognized clean energy, hydrogen energy has characteristics of high energy storage, high combustion efficiency, good thermal conductivity and environmental friendliness. It can be produced from water, a raw material with extremely rich reserves, and is the best substitute for traditional petrochemical fuels with limited reserves. Electrolysis of water is currently one of the main methods for hydrogen generation. Although the most useful catalysts for water electrolysis are mostly precious metals, such as platinum (Pt), $RuO_2$, $IrO_2$, etc., cheap stainless steel or nickel is generally used in industry as an anode to generate hydrogen by water electrolysis in a potassium hydroxide (KOH) or sodium hydroxide (NaOH) solution. In terms of hydrogen generation efficiency, an alkaline environment is far worse than a neutral environment, such as sodium carbonate ($Na_2CO_3$) and brine (NaCl), or an acidic environment, such as perchloric acid ($HClO_4$). Therefore, there is an urgent need to find a cheap anode material that can be used in a neutral or an acidic environment and is resistant to corrosion at a high potential.

To sum up, it is a great challenge to develop a stainless steel/structure that can be stably used at a high potential in a neutral or an acidic environment, which presents a breakthrough in terms of both basic theory and application.

BRIEF SUMMARY OF THE INVENTION

To solve the above technical problems, the present inventors have done a lot of research and have developed a bilayer passive film structure, which has excellent corrosion resistance in a neutral or an acidic environment, and thus can be used as a water electrolysis anode substrate material and oxygen evolution catalyst in the neutral and acidic environment.

An aspect of the present invention provides a bilayer passive film structure of a substrate, comprising an inner layer comprising an oxide of a first element, and an outer layer comprising an oxide of a second element, wherein the passivation potential of the first element is lower than the passivation potential of the second element, and the passivation potential of the second element is lower than the transpassivation potential of the first element.

Another aspect of the present invention provides a method of forming the above bilayer passive film structure of a substrate, comprising treating a surface of the substrate containing Cr and Mn.

Still another aspect of the present invention provides a stainless steel, comprising, in percentage by weight, 15%<Cr<22%, 13%<Mn<23%, 12%<Ni<23%, and 0.5%<Si<4%, wherein Si can be replaced with an equal amount of Al, Ti and/or V.

Still another aspect of the present invention provides a stainless steel, comprising, in percentage by weight, 15%<Cr<30%, 10%<Mn<30%, and 0.5%<Si<4%, wherein Si can be replaced with an equal amount of Al, Ti or V.

Yet another aspect of the present invention provides a method of treating a substrate, comprising forming the above-described bilayer passive film structure on the substrate.

Still another aspect of the present invention provides a water electrolysis anode substrate material comprising the above bilayer passive film structure, the bilayer passive film structure formed by the above method, or the above stainless steel.

Still another aspect of the present invention provides an oxygen evolution catalyst comprising the above bilayer passive film structure, the bilayer passive film structure formed by the above method, or the above stainless steel.

Still another aspect, the present invention provides a catalyst support comprising the above bilayer passive film structure, the bilayer passive film structure formed by the above method, or the above stainless steel.

BRIEF SUMMARY OF THE DRAWINGS

The foregoing and other objects and advantages of the present invention will become more apparent when considered in connection with the following detailed description and appended drawings in which like designations denote like elements in the various views, and wherein.

DETAILED DESCRIPTION OF EMBODIMENTS

Figure 1:
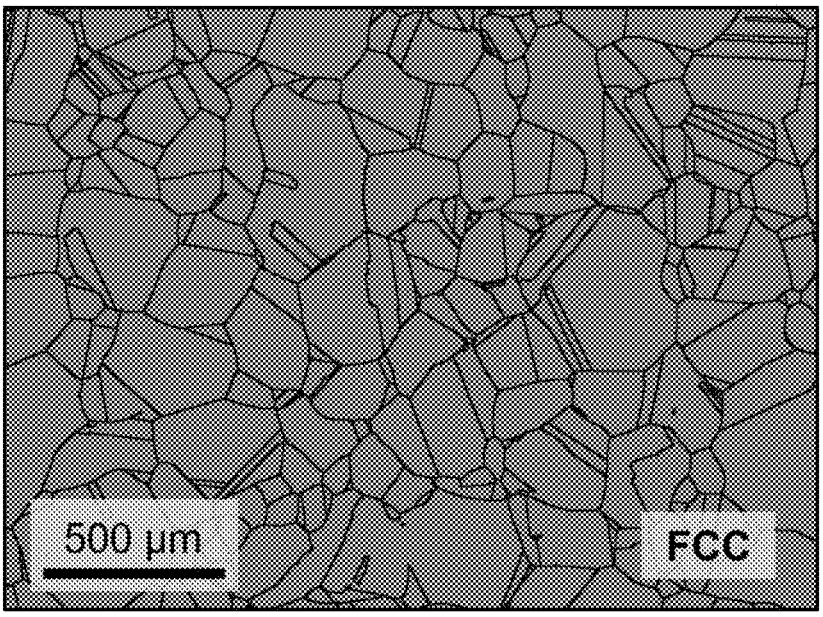
FIG. 1 shows the phase composition of Example 1 after thermal treatment.

It should be noted that "comprising" does not exclude other elements or steps, and "a" or "an" does not exclude a plurality. It should also be noted that numerical values representing quantities, reaction conditions, or the like as used in the description and claims can vary in all substances as is modified with the term "about," unless otherwise explicitly stated. At the least, it is not intended to limit the application of the principle of equivalent.

In addition, it should also be noted that any numerical range described herein is intended to encompass all the sub-ranges subsumed therein. For example, a range of "1 to 10" is intended to include all the sub-ranges between the minimum value of 1 and the maximum value of 10 (inclusive), namely, it has a minimum value equal to or greater than 1 and a maximum value equal to or less than 10.

An aspect of the present invention provides a bilayer passive film structure of a substrate, comprising an inner layer comprising an oxide of a first element, and an outer layer comprising an oxide of a second element, wherein the passivation potential of the first element is lower than the passivation potential of the second element, and the passivation potential of the second element is lower than the transpassivation potential of the first element.

The bilayer passive film structure can provide a substrate with corrosion-resistant protection at a high potential, especially in an acidic and neutral environment. As used herein, the phrase"high potential" refers to a potential above 1000 mV. As used herein, the phrase"acidic and neutral environment" refers to a liquid environment at pH 7. As used herein, the phrase "passivation potential" corresponds to the polarization potential of an anode in an electrochemical system in which elements are oxidized to form a film that protects the surface. As used herein, the phrase"transpassivation potential" corresponds to the polarization potential of an anode in an electrochemical system at which oxides of elements are further oxidized so that the oxide-based protective film is dissolved. As used herein, the phrase "transpassivation corrosion" means total corrosion, which is caused by the oxides in the passive film being further oxidized so that the oxide-based film dissolves and the metal substrate is exposed to the environment.

The bilayer passive film structure of a substrate according to the present invention is formed through consecutive multiple passivations (e.g., dual passivation) of elements with different passivation potentials. In particular, in the bilayer passive film structure according to the present invention, the passivation potential of the first element is lower than the passivation potential of the second element; thus, an inner passive film comprising an oxide of the first element is first formed at a relatively low potential, and then an outer passive film comprising an oxide of the second element is formed at a relatively high potential. Also, the passivation potential of the second element is lower than the transpassivation potential of the first element, and thus when reaching the transpassivation potential of the first element, the outer layer comprising the oxide of the second element can prevent the first element from being exposed to the environment so as to undergo a transpassivation corrosion.

Preferably, the inner layer comprising the oxide of the first element has an amorphous structure. Preferably, the outer layer comprising the oxide of the second element has an amorphous structure.

Suitably, the passivation potential of the second element is not greater than 1000 mV, such as 700 to 800 mV. Correspondingly, the passivation potential of the first element is less than 700 mV. Preferably, the second element is Mn. Preferably, the first element is Cr. Preferably, the first element is Cr, and the second element is Mn.

Preferably, the substrate comprises stainless steel. Preferably, the substrate comprises austenitic stainless steel. As used herein, the "austenitic stainless steel" has structural characteristics including a single structure and a uniform composition.

In the present invention, the corrosion resistance of the bilayer passive film structure by potentiodynamic polarization, and the specific operation are described in the examples below. Preferably, the bilayer passive film structure of a substrate according to the present invention in an acidic and neutral environment has no pitting at <1000 mV. Preferably, the bilayer passive film structure of a substrate according to the present invention in an acidic and neutral environment has no pitting at <1150 mV.

In another aspect, the present invention provides a method of forming the above bilayer passive film structure of a substrate, comprising: treating a surface of the substrate containing Cr and Mn.

In some embodiments, the substrate comprises, in percentage by weight, 15%<Cr<22%, 13%<Mn<23%, 12%<Ni<23%, and 0.5%<Si<4%, wherein Si can be replaced with an equal amount of Al, Ti or V.

In some embodiments, the substrate comprises, in percentage by weight, 15%<Cr<30%, 10%<Mn<30%, and 0.5%<Si<4%, wherein Si can be replaced with an equal amount of Al, Ti or V.

Further, the present invention provides a stainless steel comprising, in percentage by weight, 15%<Cr<22%, 13%<Mn<23%, 12%<Ni<23%, and 0.5%<Si<4%, wherein Si can be replaced with an equal amount of Al, Ti and/or V.

The stainless steel with the above composition can achieve dual passivation under the cooperation of various constituent elements, resulting in a dual passive film structure as described above, while achieving the adjustment of the microstructure and the control of the mechanical properties of the stainless steel. Moreover, the content equilibrium of the above various constituent elements makes it possible to effectively form a dual passive film structure, while avoiding the occurrence of segregation or other phenomena affecting the structural uniformity and/or continuity of the passive film. For example, the passivation property of Cr and Mn at different potentials can achieve dual consecutive passivation; Mn and Ni contribute to the formation of a uniform, stable, and simple integral austenitic structure; and Ni and Si contribute to the implementation of adjusting the microstructure of material substrate and impurities.

In particular, the main elements play the following roles:

(a) Chromium element (Cr): Chromium is a strong ferrite-forming element. As the most important component in traditional stainless steels, it plays a similar role in the present invention as that in traditional stainless steels, i.e., to form a dense oxide film at a low potential to produce a protective effect in the present invention.

(b) Manganese element (Mn): Manganese is a weak austenite-forming element. The design view of traditional stainless steels holds that the manganese element has a negative effect on stainless steels. With the increase of manganese content, the content of manganese sulfide (MnS) included in manganese increases, thereby the pitting resistance and the crevice corrosion resistance of stainless steels decrease. Therefore, the manganese content in chromium-nickel austenitic stainless steels is generally not greater than 2%. However, the manganese content in the present invention can be up to 23%. It is precisely because of taking full advantage of the passivation performance of the manganese element, that the present invention finally changes manganese from waste to wealth. The passivation effect of manganese not only prevents the over-passivation corrosion caused by the dissolution of trivalent chromium oxide, but also further improves the corrosion resistance of the present invention. This seemingly contradictory transformation is achieved by adjusting the phase composition and impurity structure of the material.

(c) Nickel element (Ni): Nickel is a strong austenite-stabilizing element, and can expand the phase area of austenite. Nickel produces little effect on the corrosion resistance of the present invention, and the additional amount thereof is matched with the contents of chromium and manganese elements with the purpose of obtaining a single austenite structure.

(d) Silicon element (Si): Silicon is used as a reductant and deoxidizer during the steelmaking process, and steels generally comprise a minor amount of silicon. In the present invention, silicon plays a role in regulating the structure of the substrate and impurities. Suitably, silicon element (Si) can be replaced with the aluminum element (Al), titanium element (Ti), and/or vanadium element (V). The replacement comprises a full or partial replacement of silicon. The addition of Si, Al, Ti and/or V helps to overcome the defect caused by simultaneously using Cr and Mn, that is, the formation of local chromium-poor regions.

The present invention further provides a stainless steel comprising, in percentage by weight, 15%<Cr<30%, 10%<Mn<30%, and 0.5%<Si<4%, wherein Si can be replaced with an equal amount of Al, Ti or V.

No Ni element is used in the stainless steel, but a bilayer passive film structure based on chromium and manganese can still be formed due to the adequate Cr and Mn contents, and the cost caused by Ni element is reduced.

Thus, the stainless steel with the above composition can form a bilayer passive film structure on the surface, i.e., an inner layer containing a Cr-based oxide and an outer layer containing an Mn-based oxide so that the outer layer protects the inner layer from transpassivation corrosion, and this bilayer structure also acts as a barrier to the outward diffusion of other elements in the substrate.

Suitably, stainless steel according to the present invention in an acidic and neutral environment has no pitting at <1000 mV. Suitably, the stainless steel according to the present invention in an acidic and neutral environment has no pitting at <1150 mV. As described in the examples below, potentiodynamic polarization is used to determine the corrosion resistance of the bilayer passive film structure, i.e., to determine if a pitting occurs.

Also, stainless steel according to the present invention has structural characteristics of a simple structure and a uniform composition and is fully austenitic stainless steel. As described in the examples below, the structure of the stainless steel is observed by a scanning electron microscope equipped with a backscattered electron detector and an energy spectrum analysis technology.

Further, stainless steel according to the present invention has good catalytic capacity for water electrolysis, and its catalytic property is superior to that of platinum metal blocks, as described in the examples below.

The stainless steel according to the present invention can meet the requirements of strength, toughness, and the like. Suitably, stainless steel according to the present invention can have a yield strength of 400 to 600 MPa. Suitably, stainless steel according to the present invention can have a tensile strength of 900 to 1100 MPa. Suitably, stainless steel according to the present invention can have an elongation of 45 to 55%. The tensile strength, yield strength, and elongation are measured in accordance with GBT 228.1-2010.

Further, the stainless steel according to the present invention comprises, in percentage by weight, 18%<Cr<20%, 18%<Mn<20%, 15%<Ni<20%, and 1%<Si<2%. Suitably, the stainless steel according to the present invention comprises, in percentage by weight, 18%<Cr<20%, 18%<Mn<20%, 15%<Ni<20%, 1%<Si<2%, and a remainder of Fe and inevitable impurities.

Further, the stainless steel according to the present invention comprises, in percentage by weight, 22%<Cr<25%, 24%<Mn<26%, and 1.5%<Si<2.5%. Suitably, the stainless steel according to the present invention comprises, in percentage by weight, 22%<Cr<25%, 24%<Mn<26%, 1.5%<Si<2.5%, and a remainder of Fe and inevitable impurities.

Suitably, stainless steel according to the present invention can further comprise a rare earth element. Suitable metals for the stainless steel of the present invention comprise but are not limited to, lanthanum (La), cerium (Ce), etc. Suitably, stainless steel according to the present invention can comprise 0.03 to 0.1 wt % of rare earth elements.

The stainless steel according to the present invention can be prepared by conventional methods in the art, including, but not limited to, casting, powder metallurgy, carbon thermal shock, etc.

For example, the stainless steel according to the present invention can be prepared by casting in accordance with the steps:

(1) melting raw materials containing various elemental constituents of the stainless steel in a vacuum induction melting furnace, and then casting into a cylindrical mold;
(2) resting the formed stainless steel block in vacuum thermal treatment, kept at 1150 to 1250° C. for 2 to 4 hours, so that the alloying elements undergo a full solid solution; and
(3) forging the homogenized block to a sheet with a thickness of around 10 mm with a final forging temperature of about 900° C. and a boundary dimension of 200 mm×100 mm×10 mm.

In yet another aspect, the present invention provides a method of treating a substrate, comprising forming the above-described bilayer passive film structure on the substrate. Suitably, the method of treating a substrate according to the present invention comprises allowing the surface of the substrate to undergo an oxidation reaction. Suitably, the oxidation reaction can occur in an electrochemical system, e.g., anode passivation.

Suitably, the anode passivation can be carried out by way of potentiodynamic polarization or potentiostatic polarization. Potentiodynamic polarization refers to increasing from a low potential to a high potential at a certain rate. Potentiostatic polarization refers to applying a constant voltage in the passive region of the first element and the passive region of the second element for a period of time, respectively. Suitably, the passive region of the first element can be −100 mV to <700 mV, and the passive region of the second element can be 700 mV to 1500 mV.

Preferably, the substrate comprises stainless steel. Preferably, the substrate comprises austenitic stainless steel. Preferably, the substrate comprises a high manganese stainless steel with an Mn content of 13% to 23%. Preferably, the high manganese stainless steel substrate further comprises 15% to 22% of chromium.

In still another aspect, the present invention provides a water electrolysis anode substrate material comprising the above bilayer passive film structure, the bilayer passive film structure formed by the above method, or the above stainless steel. The water electrolysis anode substrate material according to the present invention meets the requirements of corrosion resistance at high potential in an acidic and neutral environment.

In still another aspect, the present invention provides an oxygen evolution catalyst comprising the above bilayer passive film structure, the bilayer passive film structure formed by the above method, or the above stainless steel.

In still another aspect, the present invention provides a catalyst support comprising the above bilayer passive film structure, the bilayer passive film structure formed by the above method, or the above stainless steel.

EXAMPLES

The following examples are provided to further illustrate the present invention, but should not be construed to limit the present invention to the details of the examples.

Example 1: Stainless Steel According to the Present Invention

Composition: The stainless steel comprises, in percentage by weight, 18%<Cr<20%, 18%<Mn<20%, 15%<Ni<20%, and 1%<Si<2%, and a remainder of Fe and inevitable impurities.

The preparation steps comprise:

(1) melting raw materials containing the above various elemental constituents of the stainless steel in a vacuum induction melting furnace, and then casting into a cylindrical mold;
(2) resting the formed stainless steel block in vacuum thermal treatment, kept at 1150 to 1250° C. for 2 to 4 hours so that the alloying elements undergo a full solid solution; and
(3) forging the homogenized block to a sheet with a thickness of around 10 mm with a final forging temperature of about 900° C. and a boundary dimension of 200 mm×100 mm×10 mm.

Characterization of Structure and Property

The above-prepared sheet was subject to the characterization of structure and property.

Structure of Substrate

Figure 2:
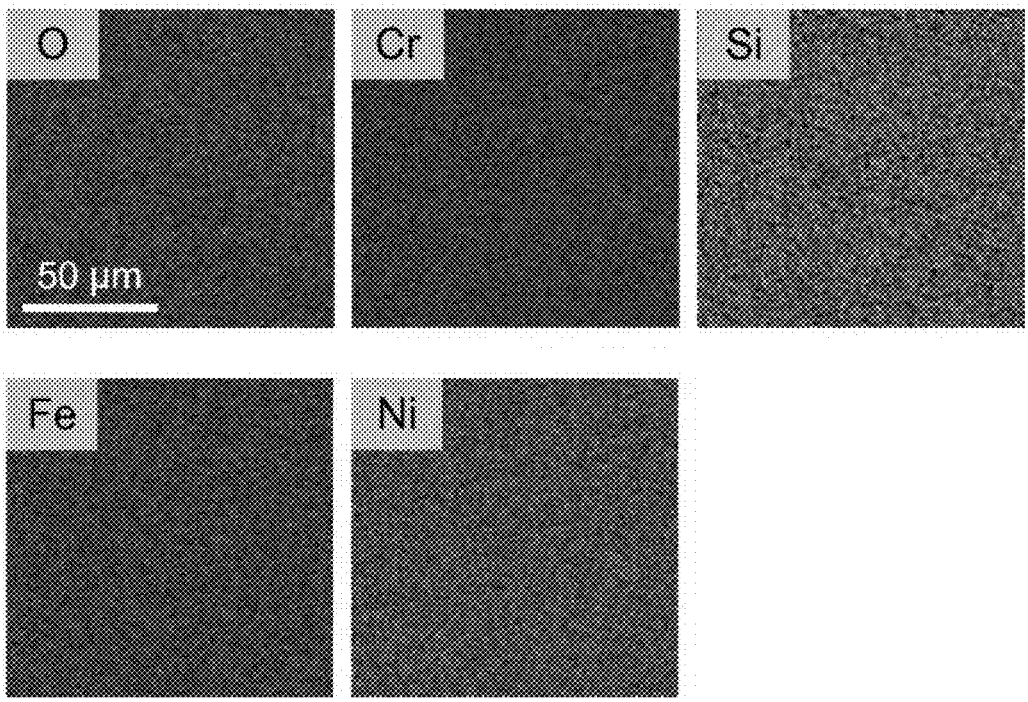
FIG. 2 shows the distribution of the chemical composition of Example 1 after thermal treatment.

In the present invention, the structure of the stainless steel of Example 1 is characterized by a scanning electron microscope equipped with a backscattered electron detector and an energy spectrum analysis technology. FIG. 1 shows the phase composition of Example 1 after thermal treatment; FIG. 2 shows the distribution of the chemical composition of Example 1 after thermal treatment.

As shown in FIG. 1, the stainless steel of Example 1 had a fully austenitic structure, in which no second phase was observed; and as seen in FIG. 2 that the stainless steel of Example 1 presented a uniform distribution of the various constituent elements with no segregation.

Corrosion Resistance

In the present invention, the corrosion resistance of Example 1 is characterized by potentiodynamic polarization.

Figure 3:
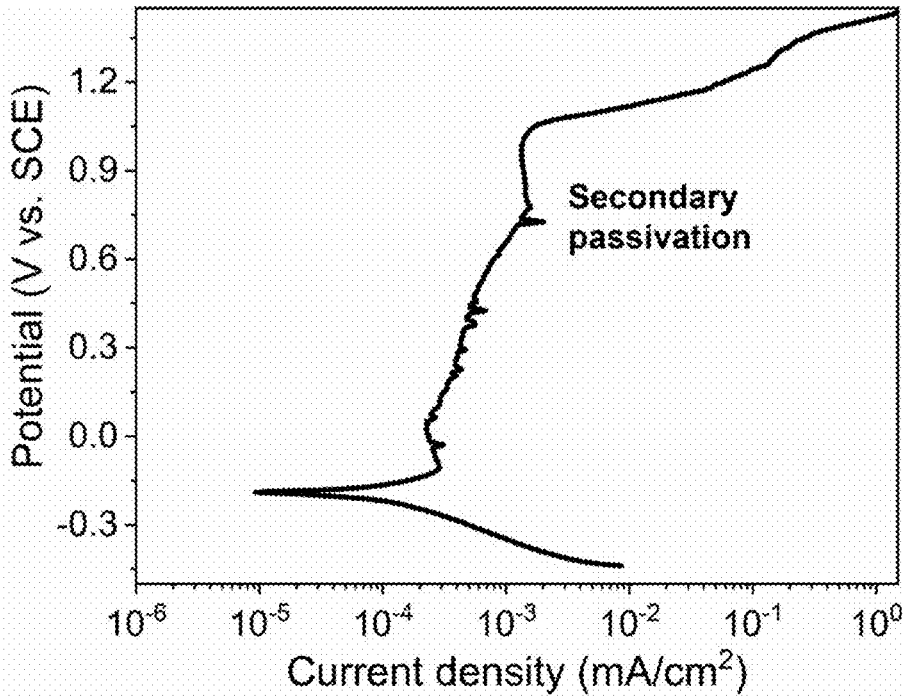
FIG. 3 shows the polarization curve of Example 1 at a relatively low potential.

FIG. 3 shows the polarization curve of the sample at a relatively low potential, wherein the test environment is a 3.5% NaCl solution, and the scanning rate is 0.1667 mV/s.

As shown in FIG. 3, no rapid increase in current density was observed at a low potential (<~1000 mV), indicating that the stainless steel of Example 1 did not undergo pitting. Among others, the current density decreased at a potential of about 770 mV, which might represent a new passivation mechanism; the current density rapidly increased at a potential of about 1150 mV, but further observation found that this case was not caused by the transpassivation corrosion, but by hydrogen and oxygen generation of water electrolysis.

Figure 4:
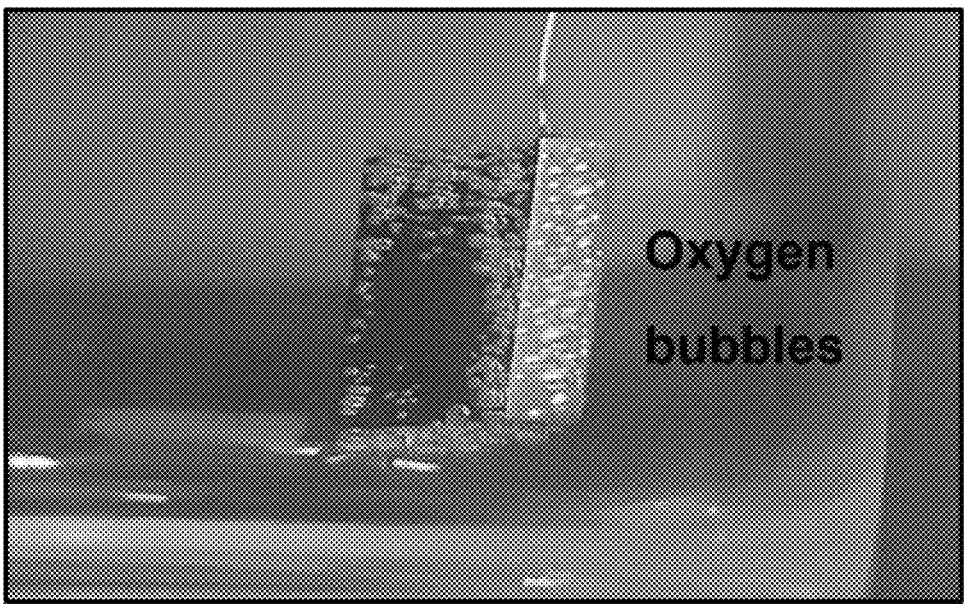
FIG. 4 shows a photograph of the surface of Example 1 at a scanning potential of 1300 mV.

Moreover, FIG. 4 shows a photograph of the sample surface at a scanning potential of 1300 mV. As seen, the stainless steel of Example 1 has broken through the limitation of traditional chromium-nickel stainless steels and can retain passive above the potential of water electrolysis without the occurrence of corrosion.

Figure 5:
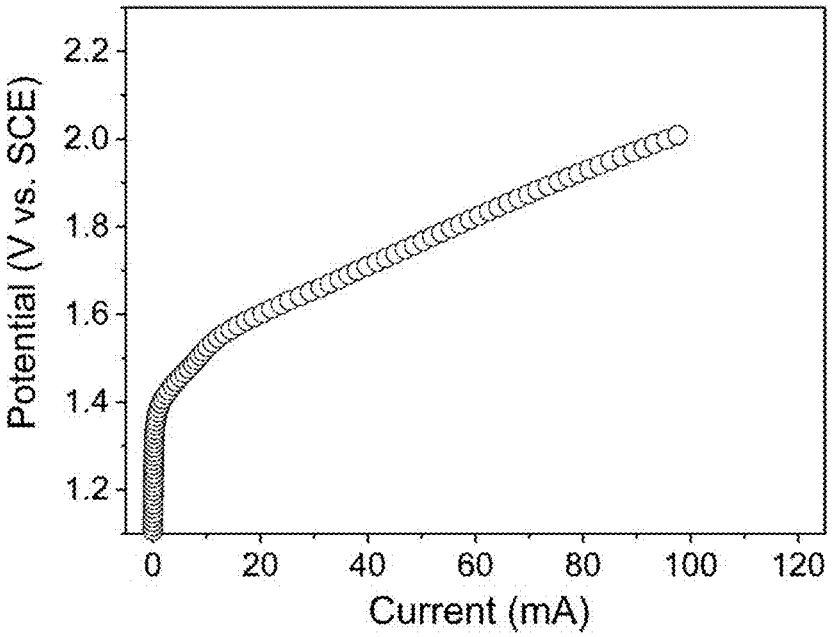
FIG. 5 shows the polarization curve of Example 1 at a relatively high potential.
Figure 6:
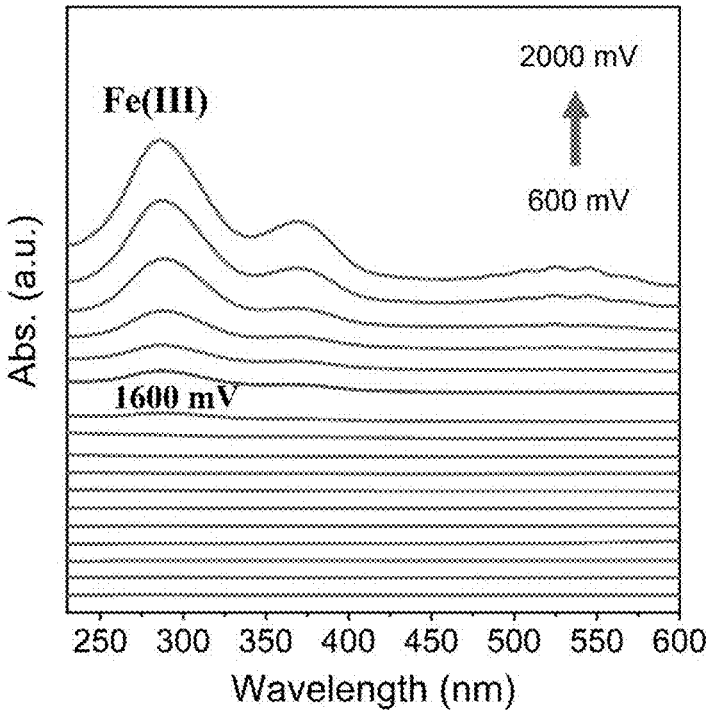
FIG. 6 shows the UV-vis absorption spectrum of the solution after electrochemical testing.

To further measure the breakdown potential of the stainless steel of Example 1, the scanning potential continuously increased. However, the breakdown potential could not be determined by the current change caused by corrosion due to the too-high current density in water electrolysis. Thus, the solutions were sampled at various stages of the potentiodynamic polarization to measure the solution with a UV-vis spectrometer, and plot the polarization curve. FIG. 5 shows the polarization curve of the samples at a relatively high potential; FIG. 6 shows the UV-vis absorption spectrum of the solution after electrochemical testing.

As shown in FIG. 5, the current changed greatly at a relatively high potential.

As shown in FIG. 6, when the potential reached 1600 mV, the solution began to show an obvious absorption peak, which was due to the light absorption of the trivalent iron phase contained in the solution by comparison with reference materials. Thus, the breakdown potential of the stainless steel of Example 1 was finally measured as 1600 mV, which was far higher than the thermodynamic limit of the traditional chromium-nickel stainless steels and the potential at which water electrolysis occurred.

To sum up, the stainless steel of Example 1 is substantially improved in terms of corrosion resistance, thereby further expanding its applications, such as, for use as water electrolysis anode substrate materials or directly as oxygen evolution catalysts.

Structure of Passive Film

Figure 7:
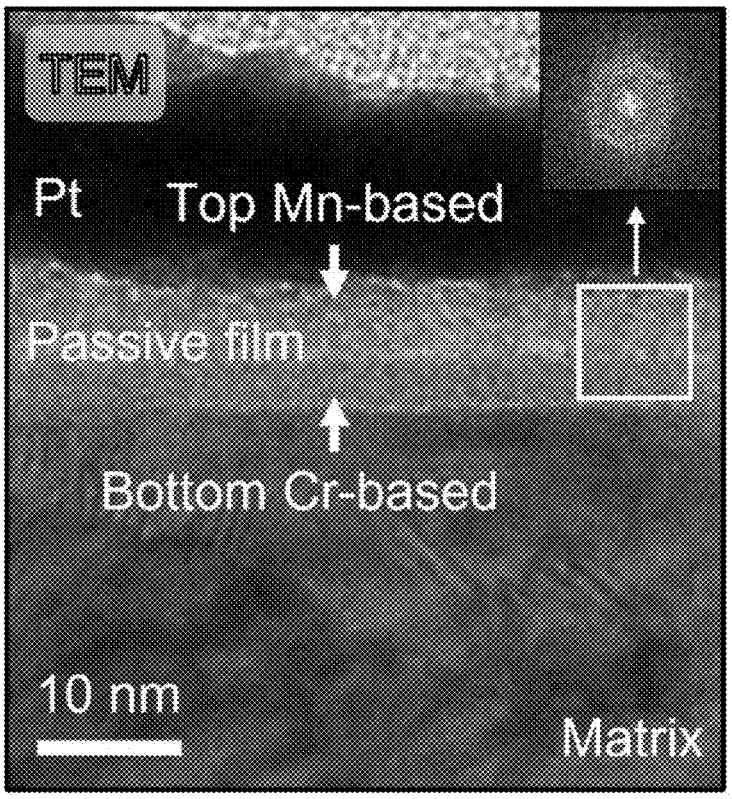
FIG. 7 shows the structure of the passive film of Example 1 subjected to potentiodynamic polarization and interrupted at 1300 mV.
Figure 8:
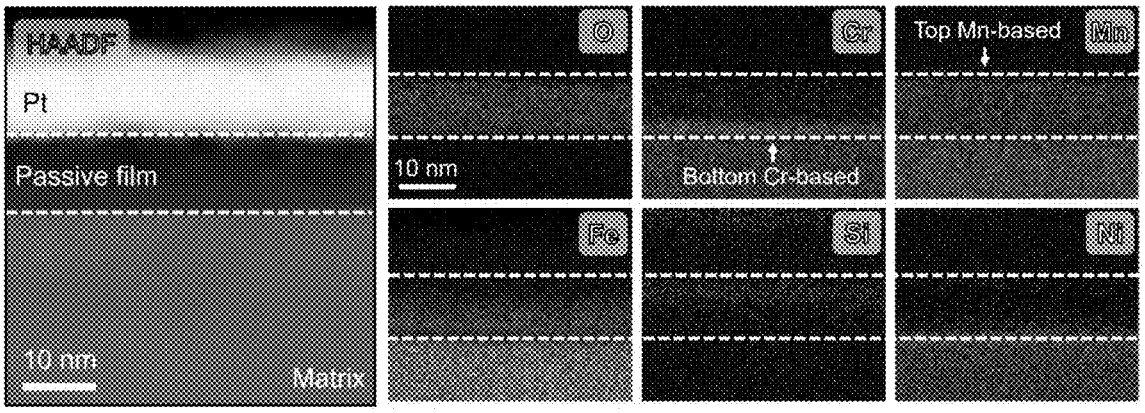
FIG. 8 shows the chemical composition of the passive film of Example 1 subjected to potentiodynamic polarization and interrupted at 1300 mV.

In the present invention, the sample passive film interface was prepared using a focused ion beam, then the structure of the passive film was directly observed by a transmission electronic microscope, and the chemical composition of the film was obtained by energy spectrum analysis. FIG. 7 shows the structure of the passive film of Example 1 subjected to potentiodynamic polarization and interrupted at 1300 mV; FIG. 8 shows the chemical composition of the passive film of Example 1 subjected to potentiodynamic polarization and interrupted at 1300 mV.

As seen in FIG. 7, the stainless steel of Example 1 presented an obvious bilayer film structure on its surface. Further, the electron diffraction result in the selected area indicates that both the inner (lower) layer and the outer (upper) layer are amorphous oxides.

As seen in FIG. 8, in the bilayer film structure, the lower (inner) layer of the passive film is a chromium-based oxide, and the upper (outer) layer is a manganese-based oxide; and many ferric ions are included between the bilayer passive film, that is because the outer manganese-based oxide was first formed from the precipitation of manganese ions, and then formed a barrier to the outward diffusion of the ionized atoms in the stainless steel substrate.

Catalytic Capacity for Water

Figure 9:
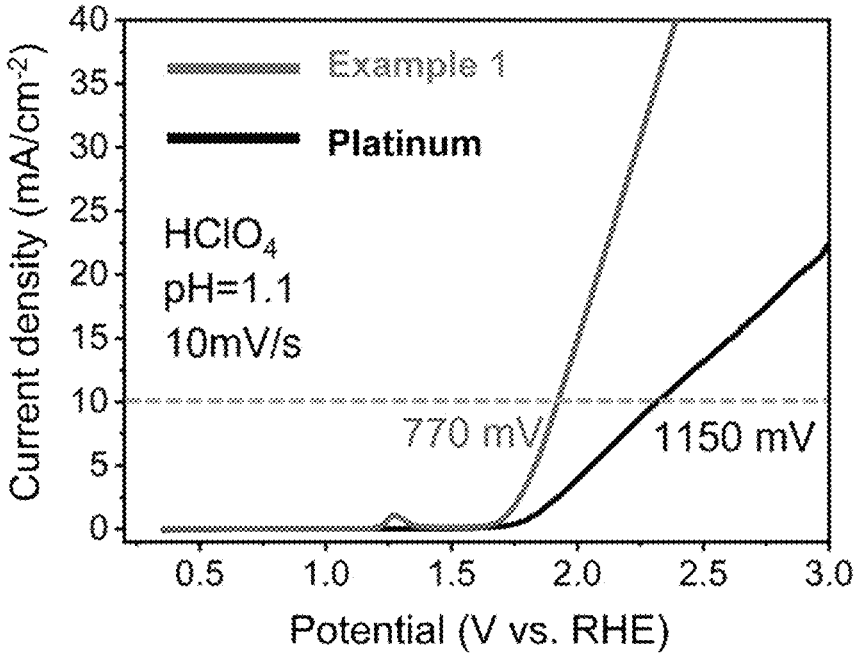
FIG. 9 shows the test results of water electrolysis catalyzed by Example 1 in an acidic environment.

In the present invention, the catalytic capacity for water of the stainless steel of Example 1 was also tested in the water electrolysis experimental system. FIG. 9 shows the test result of Example 1 catalyzing water electrolysis in an acidic environment, wherein the testing environment is an $HClO_4$ solution at pH=1.1.

As seen in FIG. 9, the stainless steel of Example 1 has good catalytic capacity for water electrolysis; the manganese-based oxide is an oxygen evolution catalyst with a transpotential of 770 mV, which is superior to block-like platinum metal.

Catalyst Support

Figure 10:
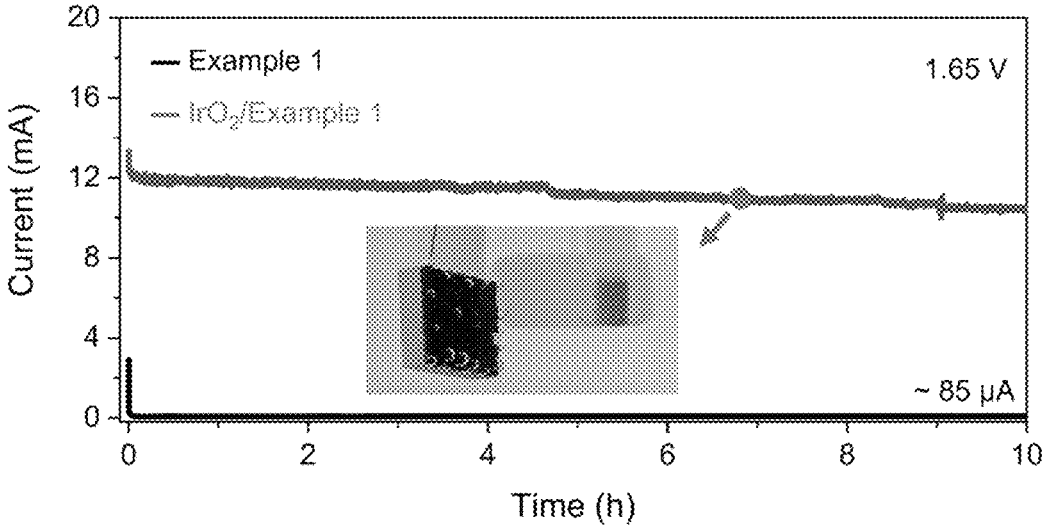
FIG. 10 shows the experiment of water electrolysis with catalyst support of Example 1 in an acidic environment.

In the present invention, the stainless steel of Example 1 was tested as catalyst support in the water electrolysis experimental system due to the superior high-potential corrosion resistance and relatively low material cost of the stainless steel. FIG. 10 shows the test result of the stability of iridium oxide catalyst-loaded Example 1 for water electrolysis in an acidic environment, wherein the testing environment is an $HClO_4$ solution at pH=1.1.

Example 2: Stainless Steel According to the Present Invention

Composition: the stainless steel comprises, in percentage by weight, 15%<Cr<30%, 10%<Mn<30%, and 0.5%<Si<4%, and a remainder of Fe and inevitable impurities.

Catalyst Support

Figure 11:
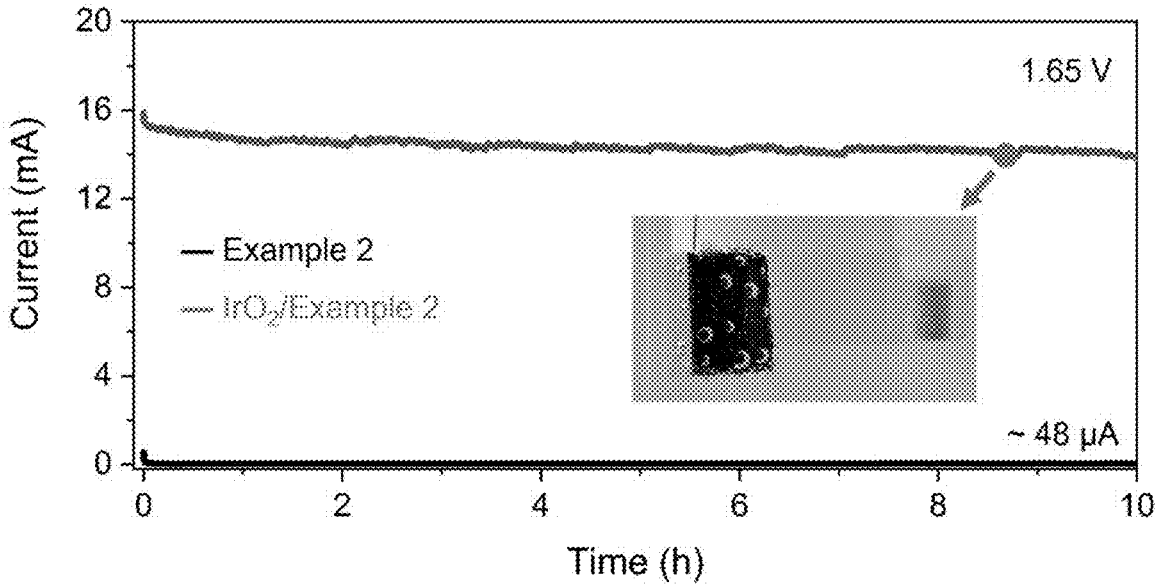
FIG. 11 shows the experiment of water electrolysis with catalyst support of Example 2 in an acidic environment.

Similarly, the stainless steel of Example 2 was subject to a catalyst support experiment. FIG. 11 shows the experiment of iridium oxide catalyst-loaded Example 2 for water electrolysis in an acidic environment. As seen in FIG. 11, Example 2 as catalyst support had strong corrosion resistance, good stability, and higher catalytic current than that of Example 1.

Although the particular aspects of the present invention have been illustrated and described, it is obvious to persons skilled in the art that many other variations and modifications can be made without departing from the spirit and scope of the present invention. Thus, the accompanying claims are intended to encompass all of these variations and modifications falling within the scope of the present invention.

The invention claimed is:

1. A bilayer passive film structure of a substrate, comprising an inner layer comprising an oxide of a first element, and an outer layer comprising an oxide of a second element, wherein the passivation potential of the first element is lower than the passivation potential of the second element, and the passivation potential of the second element is lower than the transpassivation potential of the first element.

2. The bilayer passive film structure according to claim 1, wherein the passivation potential of the second element is not greater than 1000 mV.

3. The bilayer passive film structure according to claim 2, wherein the passivation potential of the second element is 700 mV to 800 mV.

4. The bilayer passive film structure according to claim 1, wherein the second element is Mn.

5. The bilayer passive film structure according to claim 1, wherein the first element is Cr.

6. The bilayer passive film structure according to claim 1, wherein the substrate comprises stainless steel.

7. The bilayer passive film structure according to claim 1, wherein the substrate comprises austenitic stainless steel.

8. The bilayer passive film structure according to claim 1, wherein the structure has no pitting at <1150 mV in an acidic or neutral environment.

9. The bilayer passive film structure according to claim 8, wherein the structure has no pitting at <1000 mV in an acidic or neutral environment.

10. A method of forming the bilayer passive film structure of a substrate according to claim 1, comprising: treating a surface of the substrate containing Cr and Mn.

11. The method according to claim 10, wherein the substrate comprises, in percentage by weight, 15%<Cr<22%, 13%<Mn<23%, 12%<Ni<23%, and 0.5%<Si<4%, wherein Si can be replaced with an equal amount of Al, Ti or V.

12. The method according to claim 10, wherein the substrate comprises, in percentage by weight, 15%<Cr<30%, 10%<Mn<30%, and 0.5%<Si<4%, wherein Si can be replaced with an equal amount of Al, Ti or V.

13. A method of treating a substrate, comprising forming the bilayer passive film structure according to claim 1 on the substrate.

14. The method according to claim 13, comprising allowing the surface of the substrate to undergo an oxidation reaction.

15. A water electrolysis anode substrate material, comprising the bilayer passive film structure according to claim 1.

16. An oxygen evolution catalyst, comprising the bilayer passive film structure according to claim 1.

17. A catalyst support, comprising the bilayer passive film structure according to claim 1.

18. A water electrolysis anode substrate material, comprising a bilayer passive film structure formed by the method according to claim 10.

19. An oxygen evolution catalyst, comprising, a bilayer passive film structure formed by the method according to claim 10.

20. A catalyst support, a bilayer passive film structure formed by the method according to claim 10.

* * * * *